United States Patent [19]

Kushner et al.

[11] 4,456,785

[45] Jun. 26, 1984

[54] SHIELDED CABLE AND METHOD OF MANUFACTURE THEREOF

[75] Inventors: James Kushner, East Greenwich; Walter F. Constantine, Warwick; Dhiru Radadia, Lincoln; Louis S. Codega, Barrington, all of R.I.

[73] Assignee: Gulf & Western Manufacturing Company, Southfield, Mich.

[21] Appl. No.: 419,358

[22] Filed: Sep. 17, 1982

[51] Int. Cl.[3] ..... H01B 9/02; H01B 13/08; H01B 7/02

[52] U.S. Cl. ..... 174/105 SC; 156/56; 174/110 N; 174/120 R; 174/121 SR

[58] Field of Search ..... 174/105 R, 105 SC, 120 R, 174/120 SC, 121 SR, 110 N; 156/53, 56

[56] References Cited

U.S. PATENT DOCUMENTS

| | | | |
|---|---|---|---|
| 2,941,911 | 6/1960 | Kumnick | 174/120 R X |
| 3,019,285 | 1/1962 | DeLutis | 174/120 R |
| 3,033,727 | 5/1962 | Cram et al. | 156/56 |
| 3,049,584 | 8/1962 | D'ascoli | 174/120 SC |
| 3,422,215 | 1/1969 | Humes | 174/120 R |
| 3,539,409 | 11/1970 | Stone | 174/120 R X |
| 3,643,004 | 2/1972 | McKean | 174/105 SC X |
| 3,748,369 | 7/1973 | Durakis et al. | 156/56 |
| 3,790,694 | 2/1974 | Portinari | 174/121 SR X |
| 3,935,042 | 1/1976 | Wahl | 174/120 SC X |
| 4,051,324 | 9/1977 | Anderson | 174/121 SR X |
| 4,150,193 | 4/1979 | Burns, Jr. | 174/120 SC X |
| 4,226,823 | 10/1980 | Jansson et al. | 174/120 SC X |
| 4,342,880 | 8/1982 | Castelli et al. | 174/105 SC X |

FOREIGN PATENT DOCUMENTS

| | | | |
|---|---|---|---|
| 2739572 | 3/1978 | Fed. Rep. of Germany | 174/105 SC |
| 692480 | 6/1953 | United Kingdom | 174/120 |

*Primary Examiner*—J. V. Truhe
*Assistant Examiner*—Morris H. Nimmo

[57] ABSTRACT

A shielded cable is provided having good electrical properties and which may be easily terminated. The cable includes an insulated conductor which is encased within a thermoplastic tape, a supported tape, and a metallic shield. The tapes are bonded together during a heating step so that any gaps or voids are eliminated by thermoplastic flow. They may also be peeled as a unit from the insulation during a terminating operation.

7 Claims, 4 Drawing Figures

FIG1
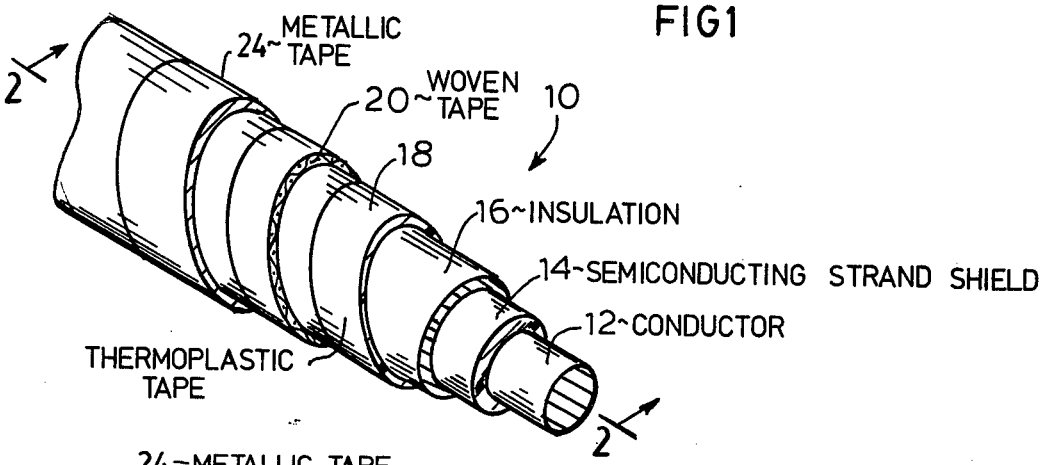
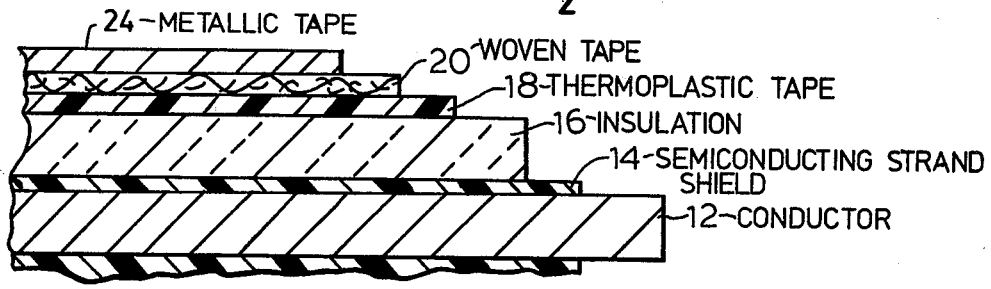
FIG.2
FIG.3
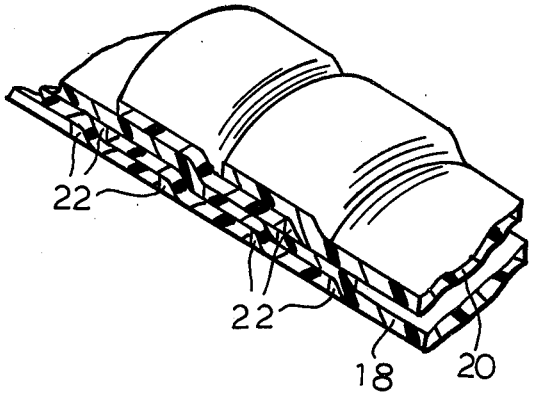
FIG.4
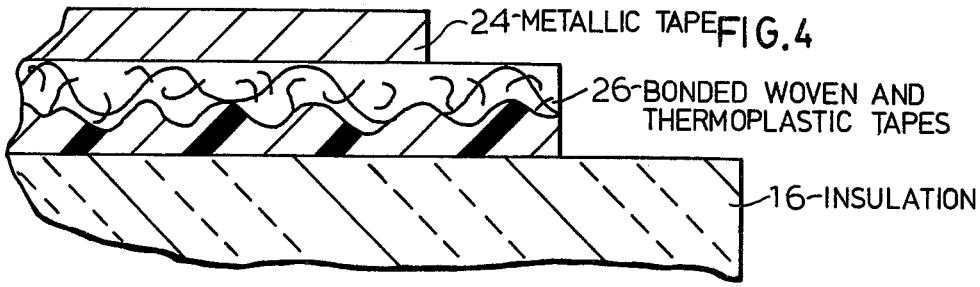

SHIELDED CABLE AND METHOD OF MANUFACTURE THEREOF

BACKGROUND OF THE INVENTION

1. Field of the Invention

The field of the invention relates to shielded cable and methods for manufacturing such cables.

2. Brief Description of the Prior Art

Protective layers or sheaths have been applied to cables for insulating them from the elements, for safety reasons, and other purposes. Three general types of insulation shields are known to the art, particularly in connection with medium voltage cable (5,000–35,000 volts). The first is an extruded shield wherein a polymer is melted, applied over the insulation through a set of dies, and vulcanized. A second type is a fabric tape coated with semiconducting material. The tape is helically applied over the insulation. A third type is a paint tape wherein a semiconducting paint is applied over the insulation to a thickness of about 0.002 inches. A semiconducting tape is applied thereover to prevent the paint from wearing off.

Each of the above described shields are characterized by certain drawbacks. Extrusion requires costly equipment and problems frequently occur in cable terminations when removing the extruded material. The material may either stick too much or too little to the insulation thereby creating problems in terminating or causing corona if adhesion is slight. This is due to the fact that it is often difficult to control the bond. Taped shields are not entirely successful as corona occurs due to the lack of adhesion and the presence of gaps at the overlaps. If paint is employed, extra work is required in its removal.

Various patents are directed to electrical cables having protective layers. U.S. Pat. No. 2,941,911, for example, discloses a tape which is applied and then heated to form a continuous sheath. U.S. Pat. No. 3,790,694 concerns an extruded thermoplastic sheath applied to a cable. U.S. Pat. No. 3,539,409 discloses a process wherein a conductor is first wrapped with a layer of epoxy-impregnated tape. A heat-shrinkable material is wrapped about the tape and heat is applied. During the curing phase, the heat-shrinkable material contracts resulting in external pressure on the epoxy layer. The epoxy thereby flows into any voids which existed prior to curing. Other prior art patents include U.S. Pat. Nos. 3,019,285, 3,422,215, and 4,051,324.

SUMMARY OF THE INVENTION

A shielded cable is provided by the invention which provides excellent electrical characteristics and which can be easily terminated. A method for manufacturing such a cable is also disclosed.

The cable includes two tapes which are applied over an insulation layer. One is designed to adhere properly to the insulation layer. The other includes a strength member and adheres to the first tape. Application of heat and pressure to the tapes causes the first tape to soften and flow into the voids created by the overlying portions thereof. The two tapes are bonded to each other such that the strength of said bond exceeds that between the first tape and the insulation. This allows both tapes to be peeled simultaneosly.

The shielded cable is manufactured by applying a first thermoplastic tape to an insulated cable. A second tape having a strength member is applied over the first. A metallic tape shield is then applied. The entire assembly is heat treated such that all voids in the first tape are eliminated and the first and second tapes are bonded together. During the heating process, the pressure builds up within the metallic shield as the cable insulation and/or other materials within the shield expand. A portion of the first thermoplastic tape is forced within the pores of the second tape thereby creating an effective bond.

BRIEF DESCRIPTION OF THE DRAWINGS

FIG. 1 is a perspective view of a shielded cable according to the invention;

FIG. 2 is a sectional view thereof taken along the plane of line 2—2 in FIG. 1;

FIG. 3 is a partially cut-away perspective view illustrating a plurality of overlying helical tapes; and FIG. 4 is a sectional view illustrating several protective layers of the shielded cable subsequent to heat treatment.

DETAILED DESCRIPTION OF THE INVENTION

A shielded cable 10 is provided which includes a plurality of protective layers. A copper conductor 12 comprises the center of the cable. A semiconducting strand shield 14 envelopes the conductor 12. This shield may be made from a polyethylene having carbon black added. Other polymers may alternatively be used. It serves to even out stress which may occur due to imperfections in the surface of the conductor 12.

An insulation layer 16 surrounds the semiconducting strand shield 14. This layer may be made from any of several materials including but not limited to ethylene/-rubber, propylene/rubber or cross linked polyethylene.

A non-supporting polymeric thermoplastic tape 18 is wrapped in helical fashion about the insulation 16. The tape is a semiconducting controlled bond polymer which may have vulcanizing ingredients therein, but not vulcanized or not have vulcanizing ingredients. The cross linking materials are peroxides which are only activated at about 270° F. Temperatures do not normally reach this level during the manufacture or use of the cable provided herein.

A woven tape 20 having a semiconducting skim is helically wrapped around the non-supported tape 18. As shown in FIG. 3, a plurality of gaps 22 are created when two tapes are applied in this manner. The steps taken to eliminate these gaps and any other voids within the cable are described below.

The woven material within tape 20 is preferably a synthetic material such as nylon. It may also be made from cotton. A non-vulcanized skim face of semiconducting material may be calendared in or spread coat on. It adjoins the outer surface of the non-supported tape 18.

A metallic tape 24 is wrapped around the woven tape 20. A good conductor such as copper is employed. The cable may then be heated to a temperature whereby the thermoplastic tape 18 softens and flows into the gaps 22. Any voids are eliminated such that the possibility of corona effect is prevented. The metallic tape 24 acts as a mold in that it controls the shape of the cable and acts as a pressurized container. As the cable is heated and the insulation 16 expands, the thermoplastic material will accordingly be forced under pressure into both the gaps 22 and the pores of the woven tape 20. The appropriate materials are selected such that the bond created between tapes 18 and 20 is greater than that between tapes 18 and 16. The cable produced in accordance with the invention is partially illustrated in FIG. 4. Tape 18 has become partially fused with tape 20 resulting in a single supported layer 26 substantially free of voids. This layer 26 may be peeled from the insulation 16 at the ends of the cable.

EXAMPLE

A medium voltage copper conductor having a semiconducting strand shield and a layer of insulation is provided. An unsupported tape of BAKELITE HFDA-0691 Black 55 is applied to the insulation. The tape is $1\frac{1}{2}\times0.007''$ and is applied with about a 10% overlap.

BAKELITE HFDA-0691 Black 55 is a commercially available product of the Union Carbide Corporation. It has traditionally been employed as a strippable insulation shield for medium voltage power cable. The product is a vulcanizable semiconductive compound which has been applied to cable by means of extrusion. Tests on molded stress-relieved slabs cured for fifteen minutes at 175° revealed the following physical properties:

Density at 23° C.: 1.13 g/cm$^3$

Brittleness Temperature: −45° C.

Secant Modulus: 5500 psi

Tensile Strength: 1800 psi

A layer of $1\frac{1}{2}\times0.010''$ supported tape having a 50 denier nylon weave is wrapped about the unsupported tape with a 10% overlap. It includes a non-vulcanized skim face of semiconducting material which adjoins the unsupported tape.

A $1.0\times0.005''$ bare copper tape is applied to the supported tape with a 25% overlap. The resulting product is cured for four hours at 200° F. This allows the insulation to expand and the unsupported tape to soften. The latter is forced under pressure into any voids within the cable. Upon cooling, the supported and unsupported tapes become one strippable layer which is easily removed from the insulation.

It will be appreciated that the copper tape employed in accordance with the invention may be protected by one or more materials. A $2.0\times0.002''$ Mylar tape may be applied with a half inch overlap. A PVC jacket having a minimum tensile strength of 1800 psi and 200% minimum elongation may then be applied thereto.

Depending upon the intended uses and operating conditions of the cable manufactured according to the methods provided herein, various materials may be substituted for those which have been specified.

What is claimed is:

1. A shielded cable comprising:

a conductor;

a layer of insulation surrounding said conductor;

a first helically wound unsupported thermoplastic tape surrounding and bonded to said insulation layer;

a second helically wound supported tape surrounding and bonded to said first tape, the bond between said first and second tapes being stronger than said bond between said insulation and said first tape such that said first and second tapes are peelable helically and as a unit from said insulation, said first and second tapes being substantially free of gaps due to tape overlap; and a layer of conducting material surrounding said second tape.

2. A shielded cable as defined claim 1 wherein said second tape includes a woven base, said first tape being at least partially integrated within the pores of said woven base.

3. A shielded cable as defined in claim 2 wherein said woven base is made from nylon.

4. A shielded cable as defined in claim 1 wherein said second tape includes a skim face of semiconducting material facing such first tape.

5. A shielded cable as defined in claims 1 or 4 including a semiconducting shield between said conductor and said layer of insulation.

6. A shielded cable as defined in claim 1 wherein said first tape is not vulcanized.

7. A method of manufacturing a shielded cable comprising the steps of:

providing a conductor having a surrounding layer of insulation;

helically wrapping a non-supported thermoplastic tape about said insulation;

helically wrapping a supported tape about said thermoplastic tape;

applying a metallic tape shield about said supported tape;

heating said conductor, insulation, tapes, and metallic tape shield such that said non-supported thermoplastic tape softens and flows into any gaps caused by overlapping portions thereof, a relatively weak bond being formed between said insulation and said non-supported tape and a relatively strong bond being formed between said non-supported tape and said supported tape whereby said non-supported tape and said supported tape can be peeled helically as one layer from said insulation when said metallic tape shield is removed.

* * * * *